US009382646B2

(12) United States Patent
Henssen

(10) Patent No.: US 9,382,646 B2
(45) Date of Patent: Jul. 5, 2016

(54) ABRASION RESISTANT YARN

(75) Inventor: Giovanni Joseph Ida Henssen, Echt (NL)

(73) Assignee: DSM IP ASSETS B.V., Heerlen (NL)

( * ) Notice: Subject to any disclaimer, the term of this patent is extended or adjusted under 35 U.S.C. 154(b) by 0 days.

(21) Appl. No.: 14/236,751

(22) PCT Filed: Aug. 17, 2012

(86) PCT No.: PCT/EP2012/066067

§ 371 (c)(1),
(2), (4) Date: Apr. 28, 2014

(87) PCT Pub. No.: WO2013/024148

PCT Pub. Date: Feb. 21, 2013

(65) Prior Publication Data

US 2014/0223880 A1 Aug. 14, 2014

(30) Foreign Application Priority Data

Aug. 18, 2011 (EP) ..... 11177994

(51) Int. Cl.
*D02G 3/04* (2006.01)
*D02G 3/44* (2006.01)

(52) U.S. Cl.
CPC ..... *D02G 3/04* (2013.01); *D02G 3/442* (2013.01); *D10B 2201/00* (2013.01); *D10B 2211/01* (2013.01); *D10B 2321/0211* (2013.01)

(58) Field of Classification Search
CPC ..... D02G 3/04; D02G 3/442
See application file for complete search history.

(56) References Cited

U.S. PATENT DOCUMENTS

| | | | | |
|---|---|---|---|---|
| 4,321,788 | A | 3/1982 | Alston | |
| 4,413,110 | A | 11/1983 | Kavesh et al. | |
| 4,426,840 | A | 1/1984 | Yasui et al. | |
| 4,435,955 | A | 3/1984 | Sumner | |
| 5,077,126 | A | 12/1991 | Green | |
| 2003/0098068 | A1 | 5/2003 | Chi et al. | |
| 2007/0137164 | A1* | 6/2007 | Kolmes et al. | 57/252 |

FOREIGN PATENT DOCUMENTS

| | | |
|---|---|---|
| EP | 0 200 547 | 11/1986 |
| EP | 0 205 960 | 12/1986 |
| EP | 0 213 208 | 3/1987 |
| EP | 0 377 243 | 7/1990 |
| EP | 0 445 724 | 9/1991 |
| EP | 0 472 114 | 2/1992 |
| EP | 1 350 868 | 10/2003 |
| EP | 1 699 954 | 11/2011 |
| GB | 2 042 414 | 9/1980 |
| GB | 2 051 667 | 1/1981 |
| WO | WO 92/10600 | 6/1992 |
| WO | WO 01/73173 | 10/2001 |
| WO | WO 03/038169 | 5/2003 |

OTHER PUBLICATIONS

Carl A. Lawrence, Fundamentals of Spun Yarn Technology (2003) CRC Press, pp. 25-26, 221-231.*

Modern Composite Yarn Production, G.R. Wray, ed., Columbine Press, Chapters 2-4, pp. 17-74 (1960).

International Search Report for PCT/EP2012/066067 mailed Sep. 26, 2012.

Kimmel et al., "Tensile Properties of Various Cotton and Dyneema Bland Yarns", Indian Journal of Fibre and Textile Research, National Institute of Science Communication and Information Resources, vol. 31, Sep. 1, 2006, pp. 376-380.

Wray, "Modern Composite Yarn Production", Columbine Press, Manchester & London, 1960.

Nakajima "Advanced Fiber Spinning Technology", Woodhead Publishing Limited, 1994, 21 pages.

BladeBuster, A comparison of Ultra High Molecular Weight Polyethylene (UHMWPE-Dyneema®) to Aramid Fiber (Kevlar) Performance, https://www.bladebuster.ca/our-products/cut-resistant-clothing/dyneema-vs-kevlar (2016).

PIP Cut Resistant Gloves & Sleeves, http://us.pipglobal.com/archive/literature/PIP-Cut-Resistant-Gloves-and-Sleeves.pdf (2016).

* cited by examiner

*Primary Examiner* — Shaun R Hurley
(74) *Attorney, Agent, or Firm* — Nixon & Vanderhye P.C.

(57) ABSTRACT

The invention relates to a spun yarn comprising at least one natural fiber and staples of a high strength polyethylene fiber, wherein the high strength polyethylene fiber has an initial modulus of at least 40 GPa and a tensile strength of at least 1.4 GPa, wherein the yarn comprises between 1 and 4% by weight staples of the high strength polyethylene fiber. The invention also relates to a fabric comprising the spun yarn and articles comprising said spun yarn or said fabric.

14 Claims, No Drawings

ABRASION RESISTANT YARN

This application is the U.S. national phase of International Application No. PCT/EP2012/066067 filed 17 Aug. 2012 which designated the U.S. and claims priority to EP 11177994.8 filed 18 Aug. 2011, the entire contents of each of which are hereby incorporated by reference.

The invention relates to a spun yarn comprising staple cotton fibers and staples of a high strength polyethylene fiber. The invention also relates to a fabric comprising said yarn and to articles made from said yarn or said fabric.

A yarn comprising staple cotton fibers and polyethylene fibers is known for example from WO92/10600. This publication discloses a yarn comprising cotton fibers and polyethylene cut fibers (tensile strength 2.6 GPa and modulus 87 GPa) having a non homogeneous distribution of the polyethylene fibers with a core section enriched with polyethylene fibers and a sheath section consisting mainly of cotton fibers. Such yarn was prepared from a roving consisting of 90 mass % cotton fibers and 10 mass % polyethylene fibers with the aid of a rotorspin box and had a tensile strength of 15 cN/tex.

It was observed that the abrasion resistance of the known yarns comprising staple cotton fibers and polyethylene fibers is insufficient to withstand mechanical action, e g. rubbing, scrapping or erosion, for a prolonged period of time. It was also observed that such yarns age rapidly under normal conditions of use and wear.

It is an aim of the present invention to provide a yarn which does not have the above mentioned disadvantages or it has them to a lesser extent.

The aim was achieved with a yarn comprising at least one natural fiber and staples of a high strength polyethylene fiber, wherein the high strength polyethylene fiber has an initial modulus of at least 40 GPa and a tensile strength of at least 1.4 GPa, characterized in that the yarn comprises between 1 and 4 mass % staples of the high strength polyethylene fiber.

It was surprisingly observed that the yarn of the invention has an optimized abrasion resistance compared to known yarns being able to retain its original appearance and structure for a prolonged period of time. It was also surprisingly found that the yarn of the invention has an optimized resiliency, being able to be deformed and released for an increased number of times without loosing its strength and without altering its form.

A further advantage of the present invention is that the yarn provides an optimized dye-ability and an optimized wearing comfort.

By fiber is herein understood an elongated body, the length dimension of which is much greater than its transverse dimensions of width and thickness. The fibers may have continuous lengths, known in the art as filaments, or discontinuous lengths, known in the art as staple fibers. Staple fibers are commonly obtained by cutting or stretch-breaking filaments, e.g. G. R. Wray, Modern composite yarn Production, Columbine Press, Manchester & London, 1960.

Preferably, the mass percentage (mass %) of high strength polyethylene fibers with respect to the total mass of fibers in the yarn of the invention is between 1 and 3, more preferably between 1 and 2.8, most preferably between 1.5 and 2.5. It was observed that below 1 mass % high strength polyethylene fibers, the advantages of the yarn of the invention are less noticeable. Above 4 mass % of high strength polyethylene fibers, the achieved resistance to abrasion was less pronounced.

In a preferred embodiment, the spun yarn substantially consists of natural fiber and staples of a high strength polyethylene fiber.

Good results are obtained when the ratio of length of the natural fiber to the length of the staples of the high strength polyolefin fiber is from 1:2 to 2:1, wherein the length of a fiber is defined as the arithmetic average length of the concerned fibers. Preferably, the ratio of length between the natural and the high strength staple fibers is form 0.66 to 1.5, more preferably from 0.75 to 1.33, even more preferably from 0.8 to 1.25 and most preferably from 0.9 to 1.1.

The titer of the high strength polyethylene fibers is preferably at least 0.1 dpf, more preferably at least 0.5 dpf, most preferably at least 1.0 dpf. The advantage thereof is that a yarn comprising lower dpf polyethylene fibers has an improved comfort. Preferably said titer is at most 10 dpf, more preferably at most 7 dpf, most preferably at most 5 dpf.

In a preferred embodiment of the invention, the ratio of the titer of the natural fiber to the titer of the high strength polyethylene fiber is from 0.2 to 5, wherein the titer of the fiber is defined as the arithmetic average titer of the concerned fiber. Preferably the ratio of the titer of the natural fiber to the titer of the high strength polyethylene fiber is from 0.5 to 3, more preferably from 1 to 2 and most preferably from 1.2 to 1.6.

Good results are obtained when the titer of the yarn of the invention is at least 10 dtex, preferably at least 40 dtex, more preferably at least 70 dtex. The maximum titer of the yarn is dictated only by practical reasons and is preferably at most 7500 dtex, more preferably at most 5000 dtex, most preferably at most 2500 dtex. A twist is preferably imparted to the yarn as it was observed that a twisted yarn has an improved mechanical stability being less prone to fraying.

The high strength polyethylene fibers may be manufactured by any technique known in the art, preferably by melt or gel spinning. If a melt spinning process is used, the polyethylene starting material used for manufacturing thereof preferably has a weight-average molecular weight (Mw) between 60,000 and 600,000, more preferably between 60,000 and 300,000. An example of a melt spinning process is disclosed in EP 1,350,868 incorporated herein by reference.

In one embodiment of the invention the high strength polyethylene fibers may be melt spun high strength polyethylene fibers. The advantage of using such fibers lies in the improved softness and comfort of the invention.

Alternatively the high strength polyethylene fiber is a gel spun polyethylene fiber. If a gel spinning process is used to manufacture said fibers, preferably an ultrahigh molecular weight polyethylene (UHMWPE) is used. The UHMWPE has an intrinsic viscosity (IV) of preferably at least 5 dl/g, more preferably at least 7 dl/g, most preferably at least 10 dl/g. Preferably the IV is at most 40 dl/g, more preferably at most 25 dl/g, more preferably at most 15 dl/g. Preferably the UHMWPE fibers are manufactured according to a gel spinning process as described in numerous publications, including EP 0205960 A, EP 0213208 A1, U.S. Pat. No. 4,413,110, GB 2042414 A, GB-A-2051667, EP 0200547 B1, EP 0472114 B1, WO 01/73173 A1, EP 1,699,954 and in "*Advanced Fibre Spinning Technology*", Ed. T. Nakajima, Woodhead Publ. Ltd (1994), ISBN 185573 182 7. Known gel spun UHMWPE fibers are for example those commercialized by DSM N.V. the Netherlands under the name of Dyneema®.

A gel spun UHMWPE fibers may be used as polyethylene fibers. The advantage of using gel spun UHMWPE fibers is that the yarn of the invention shows a further improved abrasion resistance. Good results, in particular in terms of the yarn's lifetime were also obtained when gel spun UHMWPE staple fibers were used.

Good results can be obtained if the high strength polyethylene staple fibers have an average length of between 10 mm and 100 mm, preferably between 20 mm and 80 mm, more preferably between 30 mm and 60 mm.

In a preferred embodiment of the invention, the natural fiber is selected from the group consisting of cotton and wool. Preferably the natural fiber is cotton. Cotton is a staple fiber that is commonly used to produce spun yarns. In addition to being cost efficient, cotton has good absorbency, is comfortable to wear, launders well, and tends to be relatively durable.

Preferably, the staple cotton fibers have lengths of at least 20 mm, more preferably 30 mm, the staple cotton fibers having preferably lengths of at most 50 mm, more preferably at most 40 mm. It was observed that said lengths are the optimum lengths for spinning the yarn of the invention.

The spun yarn may be manufactured by any technique known in the art such as ring spinning process or open-end spinning process. The yarn of the invention may be spun with a ring spinning process from a blend of cotton fibers and high strength polyethylene staple fibers. An advantage of applying the ring spinning process is that the mechanical treatment and process temperature are more suitable for the high strength polyethylene staple fibers. The yarn of the invention may also be spun with a open-end spinning process from a blend of cotton fibers and high strength polyethylene staple fibers. An advantage of applying the open-end spinning process is the higher productivity of such a process whereas the amount of high strength polyethylene staple fibers present in the yarn according to the invention may be optimized in view of the high productivity.

Finishes suitable for spinning are used commercially and known to those in the art. Aspects of the spinning process have been discussed and described in numerous publications over the last decades. Examples of such publications are U.S. Pat. Nos. 4,435,955; 4,426,840 and 4,321,788.

Preferably, the yarn of the invention is twisted between 1 and 6 times per linear cm, more preferably between 2 and 5 times per linear cm and most preferably between 3 and 4.5 times per linear cm.

The yarn of the invention may also contain other natural and/or synthetic fibers. Examples of natural fibers include cellulose, hemp, silk, jute, sisal, cocos, linen and the like. Examples of synthetic fibers include those manufactured from semicrystalline polymers e.g. polypropylene; polyoxymethylene; poly(vinylidine fluoride); poly(methylpentene); poly(ethylene-chlorotrifluoroethylene); polyamides and polyaramides, e.g. poly(p-phenylene terephthalamide) (known as Kevlar®); poly(tetrafluoroethylene) (PTFE); poly{2,6-diimidazo-[4,5b-4',5'e]pyridinylene-1,4(2,5-dihydroxy)phenylene} (known as M5); poly(p-phenylene-2,6-benzobisoxazole) (PBO) (known as Zylon®); poly(hexamethyleneadipamide) (known as nylon 6,6); polybutene; polyesters, e.g. poly(ethylene terephthalate), poly(butylene terephthalate), and poly(1,4 cyclohexylidene dimethylene terephthalate); polyvinyl alcohols and thermotropic liquid crystal polymers. Examples of suitable thermotropic liquid crystal polymers include aromatic polyesters that exhibit liquid crystal properties when melted and which are synthesized from aromatic diols, aromatic carboxylic acids, hydroxycarboxylic acids, and other like monomers. Typical examples include a first type consisting of parahydroxbenzoic acid (PHB), terephthalic acid, and biphenol; and second type consisting of PHB and 2,6-hydroxynaphthoic acid; and a third type consisting of PHB, terephthalic acid, and ethylene glycol.

The manufacturing process of the yarn may result in a predominantly homogeneous yarn. Hence the invention also relates to a homogeneous yarn. By homogeneous yarn is understood a yarn that does not show a concentration gradient of the high strength polyethylene staples across a cross section orthogonal to the machine direction of the yarn. By homogeneous yarn is further understood that the ratio between the highest and lowest weight percentage of high strength polyethylene staples across said cross-section is at most 2, preferably at most 1.8 and most preferably at most 1.5. Yarns with more homogeneous distribution of the high strength polyethylene staples across the yarn show further improved abrasion resistance properties.

The invention also relates to a fabric comprising the spun yarn of the invention.

The fabric of the invention may be of any construction known in the art, e.g. woven, knitted, plaited, braided or non-woven or combinations thereof. Woven fabrics may include plain weave, rib, matt weave and twill weave fabrics and the like. Knitted fabrics may be weft knitted, e.g. single- or double-jersey fabric or warp knitted. An example of a non-woven fabric is a felt fabric. Further examples of woven, knitted or non-woven fabrics as well as the manufacturing methods thereof are described in "*Handbook of Technical Textiles*", ISBN 978-1-59124-651-0 at chapters 4, 5 and 6, the disclosure thereof being incorporated herein as reference. A description and examples of braided fabrics are described in the same Handbook at Chapter 11, more in particular in paragraph 11.4.1, the disclosure thereof being incorporated herein by reference.

Preferably the fabric of the invention is a knitted or a woven fabric. Good results were obtained with circular knit fabrics as well as with a tricot warp knit, flat knit or a plain weave fabric. It was observed that such fabrics show an increased degree of flexibility and softness while having an improved abrasion resistance, in particular after washing. Cotton, in contrast, tends to become stiff and "board-like" after washing. A flat knit proved to be particularly advantageous when used to construct gloves.

The invention also relates to articles comprising the fabric of the invention. In particular the articles are in the fields of clothing, e.g. outerwear, garments, raiment and the like. Examples of such articles include but are not limited to gloves, aprons, chaps, pants, shirts, jackets, coats, socks, undergarments, vests, hats and the like.

It was also observed that such articles due to their improved abrasion resistance are suitable for use in army camouflage apparels.

The invention also relates to articles comprising the yarn of the invention other than the specifically mentioned fabrics. In particular the articles comprising the yarn of the invention are in the field of sports, medical uses or agriculture. Examples of such articles include ropes, nets, fishing lines, cords and the like.

The invention will be elucidated below with the aid of a number of examples.

Test Procedures

Tenacity, $F_{max}$ and elongation at break (EaB) of the produced yarns are measured on a Zwick tensile tester according to ISO 2062-93(A).

Fabrics are subjected to a Martindale abrasion resistant test according to ISO EN388. The standard sandpaper type has been replaced by the finer grain P240.

Experimental Details

Spinning of the different yarns have been performed by ring spinning employing cotton staple fibers optionally with high strength polyolefin staple fibers prepared from Dyneema® 1760-SK60 1 dpf cut into 32 mm staple fiber. Compositions as well as mechanical properties of the yarns are represented in table 1.

TABLE 1

| Properties of Yarns | | | | | |
|---|---|---|---|---|---|
| | Cotton/Dyneema [mass/mass] | Titer [CC] | Tenacity [cN/dtex] | $F_{max}$ [N] | EaB [%] |
| Yarn A | 100/0 | 10/1 | 0.9 | 5.4 | 3.90 |
| Yarn B | 95/5 | 10/1 | 1.3 | 8.1 | 4.75 |
| Yarn C | 90/10 | 10/1 | 1.5 | 8.6 | 5.12 |
| Yarn 1 | 98/2 | 10/1 | 1.7 | 10.1 | 5.25 |

Plain single layer woven fabrics (A, B, C and 1) have been produced from a warp yarn and a weft yarn of the yarns A, B, C and 1 respectively. The plain weaves have been subjected to the Martindale Abrasion test equipped with P240 sandpaper. Abrasion test results of the fabrics (A, B, C and 1) can be found in table 2.

TABLE 2

| Martindale test results | | | | |
|---|---|---|---|---|
| number of cycles | Fabric 1 | Fabric A | Fabric B | Fabric C |
| $1^{st}$ breakthrough | 150 | 100 | 75 | 175 |
| $2^{nd}$ breakthrough | 250 | 125 | 175 | 175 |
| $3^{rd}$ breakthrough | 300 | 200 | 175 | 225 |
| $4^{th}$ breakthrough | 400 | 250 | 225 | 225 |
| $5^{th}$ breakthrough | 400 | 275 | 225 | 300 |
| $6^{th}$ breakthrough | 500 | 275 | 275 | 300 |
| $7^{th}$ breakthrough | 650 | 300 | 275 | 350 |
| $8^{th}$ breakthrough | 700 | 325 | 420 | 350 |
| Average number of cycles till next break | 77 | 32 | 38 | 29 |

The invention claimed is:

1. A spun yarn comprising natural fibers and high strength polyethylene staple fibers, wherein the high strength polyethylene staple fibers have an initial modulus of at least 40 GPa and a tensile strength of at least 1.4 GPa, and wherein the yarn comprises between 1 and 4% by weight of the high strength polyethylene staple fibers, and wherein the yarn is a homogenous mixture of the natural fibers and the high strength polyethylene fibers which does not exhibit a gradient of the high strength polyethylene staple fibers across a cross-section of the yarn orthogonal to a machine direction of the yarn such that a ratio of highest and lowest weight percentages of the high strength polyethylene staple fibers across the cross-section of the yarn orthogonal to the machine direction of the yarn is at most 2.

2. The spun yarn of claim 1, wherein the yarn comprises between 1 and 3% by weight of the high strength polyethylene staple fibers.

3. The spun yarn of claim 1, wherein the yarn comprises between 1 and 2.8% by weight of the high strength polyethylene staple fibers.

4. The spun yarn of claim 1, wherein the yarn substantially consists of the natural fibers and the high strength polyethylene staple fibers.

5. The spun yarn of claim 1, wherein a ratio of length of the natural fibers to length of the high strength polyethylene staple fibers is from 1:2 to 2:1, and wherein each of the lengths of the natural fibers and the high strength polyethylene staple fibers is an arithmetic average length thereof.

6. The spun yarn of claim 1, wherein a ratio of titer of the natural fibers to titer of the high strength polyethylene staple fibers is from 0.2 to 5, and wherein each of the titers of the natural fibers and the high strength polyethylene staple fibers is an arithmetic average titer thereof.

7. The spun yarn of claim 1, wherein the high strength polyethylene staple fibers are gel spun high strength polyethylene staple fibers.

8. The spun yarn of claim 7, wherein the polyethylene of the gel spun high strength polyethylene staple fibers is an ultrahigh molecular weight polyethylene (UHMWPE).

9. The spun yarn of claim 1, wherein the natural fibers are at least one selected from the group consisting of cotton and wool.

10. The spun yarn of claim 1, wherein the ratio of the highest and lowest weight percentages of the high strength polyethylene staple fibers across the cross-section of the yarn orthogonal to the machine direction of the yarn is at most 1.8.

11. The spun yarn of claim 1, wherein the ratio of the highest and lowest weight percentages of the high strength polyethylene staple fibers across the cross-section of the yarn orthogonal to the machine direction of the yarn is at most 1.5.

12. A fabric comprising the spun yarn of claim 1.

13. An article comprising the fabric of claim 12.

14. An article comprising the spun yarn of claim 1.

* * * * *